US006968722B2

(12) United States Patent
Karhumäki

(10) Patent No.: US 6,968,722 B2
(45) Date of Patent: Nov. 29, 2005

(54) PLATE PROCESSING DEVICE

(75) Inventor: Markku Karhumäki, Riihimäki (FI)

(73) Assignee: Rondeco Oy, Rithimäki (FI)

( * ) Notice: Subject to any disclaimer, the term of this patent is extended or adjusted under 35 U.S.C. 154(b) by 0 days.

(21) Appl. No.: 10/381,480

(22) PCT Filed: Sep. 26, 2001

(86) PCT No.: PCT/IB01/01766

§ 371 (c)(1),
(2), (4) Date: Aug. 27, 2003

(87) PCT Pub. No.: WO02/26413

PCT Pub. Date: Apr. 4, 2002

(65) Prior Publication Data

US 2004/0035175 A1 Feb. 26, 2004

(30) Foreign Application Priority Data

Sep. 26, 2000 (FI) ..... 20002116

(51) Int. Cl.[7] ..... B21D 5/04
(52) U.S. Cl. ..... 72/307; 72/306; 72/319; 83/199
(58) Field of Search ..... 72/306, 307, 166, 72/287, 323, 319; 83/199

(56) References Cited

U.S. PATENT DOCUMENTS 3,149,518 A * 9/1964 Winestock ..... 83/176
3,815,393 A 6/1974 Daniels
4,181,002 A 1/1980 Eckhold et al.
4,412,466 A * 11/1983 Jurkowski ..... 83/200
4,756,863 A * 7/1988 Petershofer ..... 264/322
4,875,356 A * 10/1989 Boardman et al. ..... 72/321
5,495,741 A * 3/1996 Yamada ..... 72/387
5,507,168 A 4/1996 Mizukawa et al.
6,029,493 A * 2/2000 Maier et al. ..... 72/312
6,487,888 B1 * 12/2002 Baulier et al. ..... 72/418

FOREIGN PATENT DOCUMENTS

| | | |
|---|---|---|
| AU | 4188093 B | 5/1994 |
| DE | 4206417 A1 | 9/1993 |
| DE | 4343123 A1 | 6/1995 |
| FR | 2713965 | 6/1995 |
| GB | 2344546 A | 6/2000 |
| NL | 8203340 | 3/1984 |

* cited by examiner

*Primary Examiner*—Daniel C. Crane

(74) *Attorney, Agent, or Firm*—Venable LLP; Eric J. Franklin

(57) ABSTRACT

A plate-processing device intended for bending and cutting of bending and bendable plate-like objects. A bending and cutting tool is arranged to be moved by actuators. At least two tube sectors, which are arranged within each other and move relative to each other, of which the tube sector that revolves around the axis of revolution has a bending or cutting tool. The mutual movement of the tube sectors is brought about by actuators acting between the tube sectors and expandable by means of pressure of a medium.

13 Claims, 16 Drawing Sheets

DET 1

PLATE PROCESSING DEVICE

This application is a 371 of PCT/IB01/01766, filed Sep. 26, 2001.

FIELD OF THE INVENTION

The invention relates to plate processing device. The invention further relates to a method for processing a plate.

BACKGROUND OF THE INVENTION

Metal plates are normally bent within a long gap. The bending means generally obtains its driving power by means of a hydraulic cylinder or some other mechanism, and since the driving power is brought either from one point or a few points, the apparatus must be fairly rigid and stable. For this reason the apparatus is usually expensive to manufacture. The deflection of the apparatus usually obeys a generally known rule, which is proportional to the third power of the span length. Similarly, the thickness of structure has the same effect when the profile is constant. A plate-bending machine with holding jaws and a pivotable forming tool is known e.g. from German application publication 4343123 and from German application publication 2248679 corresponding to U.S. Pat. No. 3,815,393.

Swiss patent 620609 corresponding e.g. to U.S. Pat. No. 4,181,002 introduces a plate-bending device in which bending against a counter element is brought about by a forming member that is mounted for rotational movement in a housing of a mounting element and forms jaws that bend the plate edge against the counter element. The rotational movement of the forming member is brought about by moving the mounting element towards the counter element by a hydraulic cylinder. The device is a tool that is transferred manually in a direction parallel with the plate edge.

SUMMARY AND OBJECTS OF THE INVENTION

An object of the invention is to construct a plate-bending and cutting device operating on a totally different principle, wherein it will be light-weighted and inexpensive. Another object of the invention is to design a safe device, whereby risks to occupational safety can be avoided, especially of fingers being clamped. The device according to the invention is composed of at least two tube elements or tube sectors that are cut open partly in a sector-like configuration and rotating within each other. Inside the intact sector part of the tubes or in a space between radial projections outside the tube elements is directed hydraulic pressure or gas pressure inside inflatable hose-like power elements that act between the tube sectors and operate as actuators to bring about bending or cutting movement.

BRIEF DESCRIPTION OF THE DRAWINGS

In the following, the invention will be described in more detail with reference to the appended drawings, in which.

DETAILED DESCRIPTION OF THE INVENTION

Figure 1:
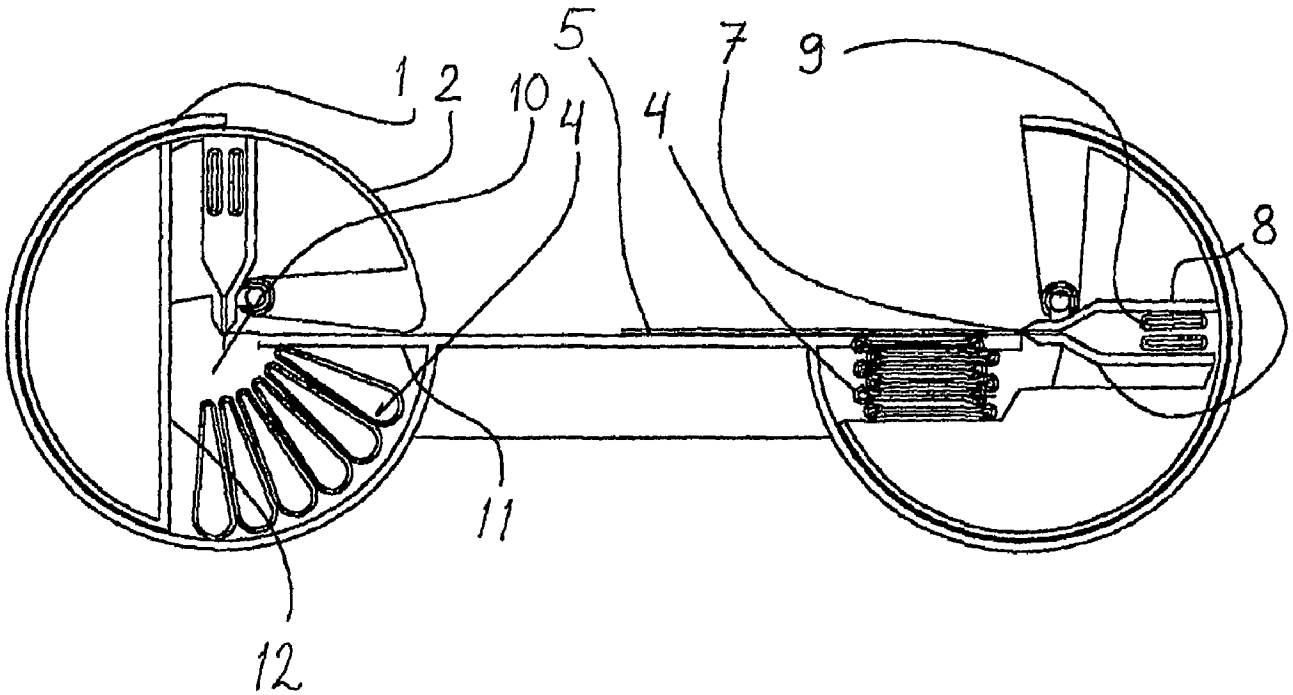
FIG. 1 shows a cross-section of a first embodiment of the device.

FIG. 1 shows the device in a cross-section perpendicular to the rotation axis of its tube elements and to the plane of the plate processed therein. The device comprises two tube elements or tube sectors 1, 2 which are arranged concentrically within each other in a manner that one is fixedly positioned and the other is arranged to rotate around the mutual central axis of the elements in order to implement a plate-processing movement (bending, cutting or other working). Between the tube sectors 1, 2 flexible hose-like power elements that expand by pressure medium and operate as actuators 4 are effective, by means of which the movement of the moving tube sector 2 can be implemented within a certain movement range and, in a corresponding manner, the power necessary for working the plate is produced. The power elements are elongated deformable means that are located in parallel with the bending or cutting line, the walls of said means being flexible to enable deformation by the influence of pressure change of the medium. The structure and the location of the power elements are described in more detail in the following.

The pressure of the medium, such as hydraulic pressure or gas pressure makes the hose-like elements inflate and rotates the innermost tube element 2 relative to the static element 1 up to the limit where the plate 5 to be bent is wished to be bent. In accordance with the invention, the same pressure can be used for closing by a hose unit 9, which is placed inside handle parts 8 of bending pliers 7 and inflate by pressure. There may be one hose or a plurality of hoses. One handle part 8 is pivotally connected to turn to the inner tube element 2, and the opposite handle part 8 is fixedly connected to the tube element.

In accordance with the invention, the pressure and the torsion brought about thereby is distributed evenly over the entire length that is bent and it stresses walls 11 and 12 of a space 10 that remains inside the outer tube element 1, one of said walls being a radial wall 11 of the outer tube element, and the other being a radial wall 12 of the inner, moving tube element.

When the inner tube element 2 (FIG. 1) rotates and slides along the inner surface of the outer tube 1, also here the pressure is distributed over a large area and thus no large local powers are directed to the structure. In accordance with the invention, these hose-like elements are advantageously used a plurality of them in parallel/in series because less pressure is required since the contact areas of the hoses are in this case larger.

Figure 2:
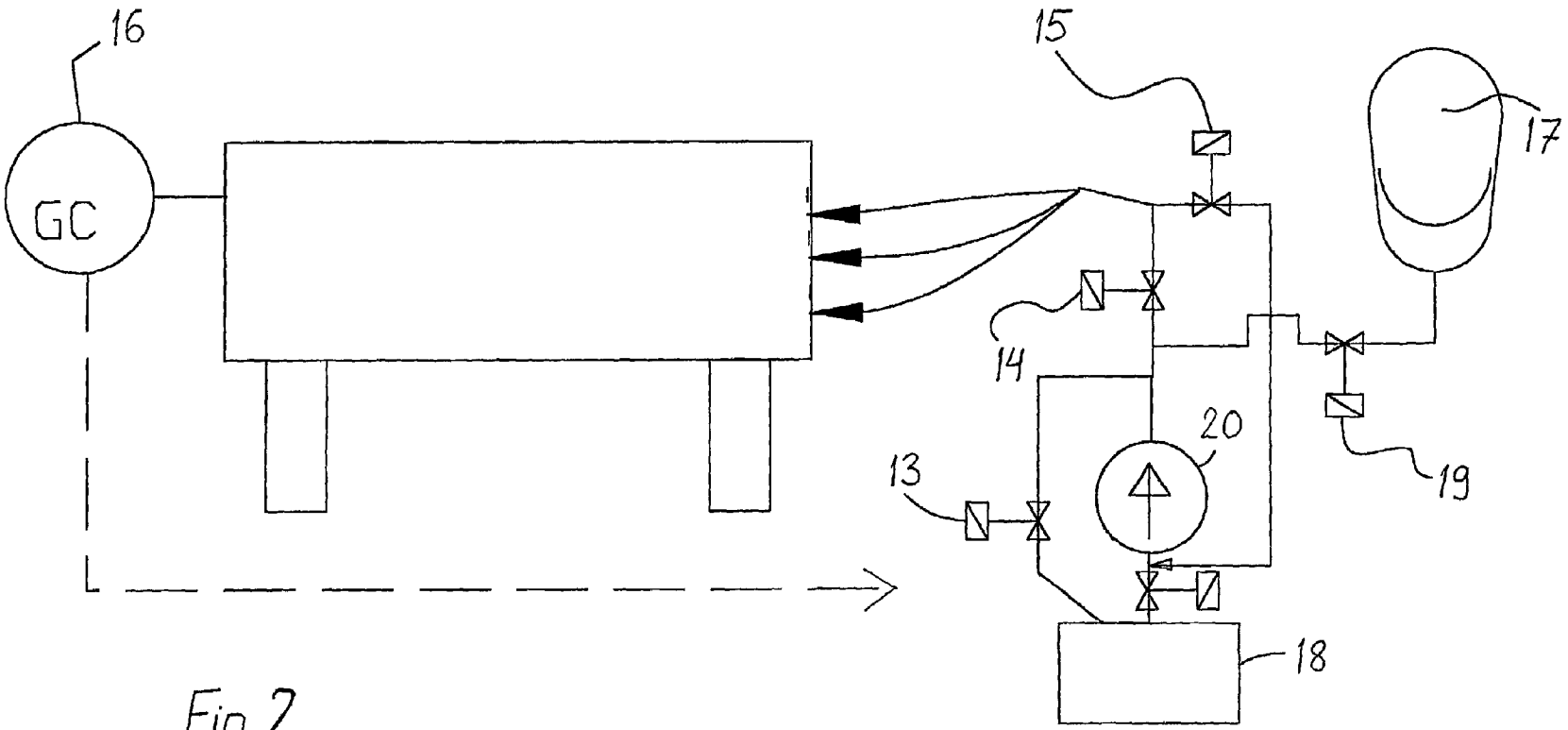
FIG. 2 shows schematically the pressure system of the device.

FIG. 2 shows schematically a pressure medium system related to the device for implementing working movements, in this case a hydraulic system. A directional valve 14 located on the pressure side of the pump 20 releases pressure liquid to the actuator 4. As can be seen in the figure, a plurality of hose-like actuators can be coupled in parallel to the pressure line. When the turning of the inner tube 2 (FIG. 1) has reached a certain desired and adjusted angle, the valve 14 closes, and a valve 15 in a return line between the actuators 4 and a pressure fluid container 18 opens to release pressure. At the same time, a valve 13 in a return line between the pressure side of the pump 20 and the container 18 turns the pressure fluid supplied by the pump to flow back to the container 18. The figure also shows a pressure accumulator 17 connected to the pressure side of the pump, and a valve 19 in a corresponding line. An electronic sensor 16 that controls the valve assembly can be used to adjust the bending angle.

A second embodiment of the invention (FIG. 3) comprises also a third tube sector 3 which can, in a corresponding manner, be moved by the influence of a bellows or other power, and this closes, by means of a holding clamp 6, the plate 5 to be bent to its bending underlay. The left side shows the tube sectors in a position in which they have bent the plate into the adjusted bending angle. The third tube sector 3 turns around an inner, fixedly positioned tube sector 1 by means of actuators 9, which act upon the projection projecting radially from the tube sector. Inside the inner tube sector 1 there is an innermost, moving tube sector 2, which is arranged to be turned by actuators 4, said tube sector 2 comprising a projection, which extends inwards in the radial direction and forms a part that bends the edge of the plate 5 behind the holding clamp 6, i.e. a bending tool 27.

The plate-bending device according to the invention is very inexpensive and easy to build compared to the heavy-weighted devices for the same work processes on the market. Similarly, it is easy to transfer from one place to another and it can also be easily connected to work as an auxiliary device in automatic sheet metal working centres.

Figure 4:
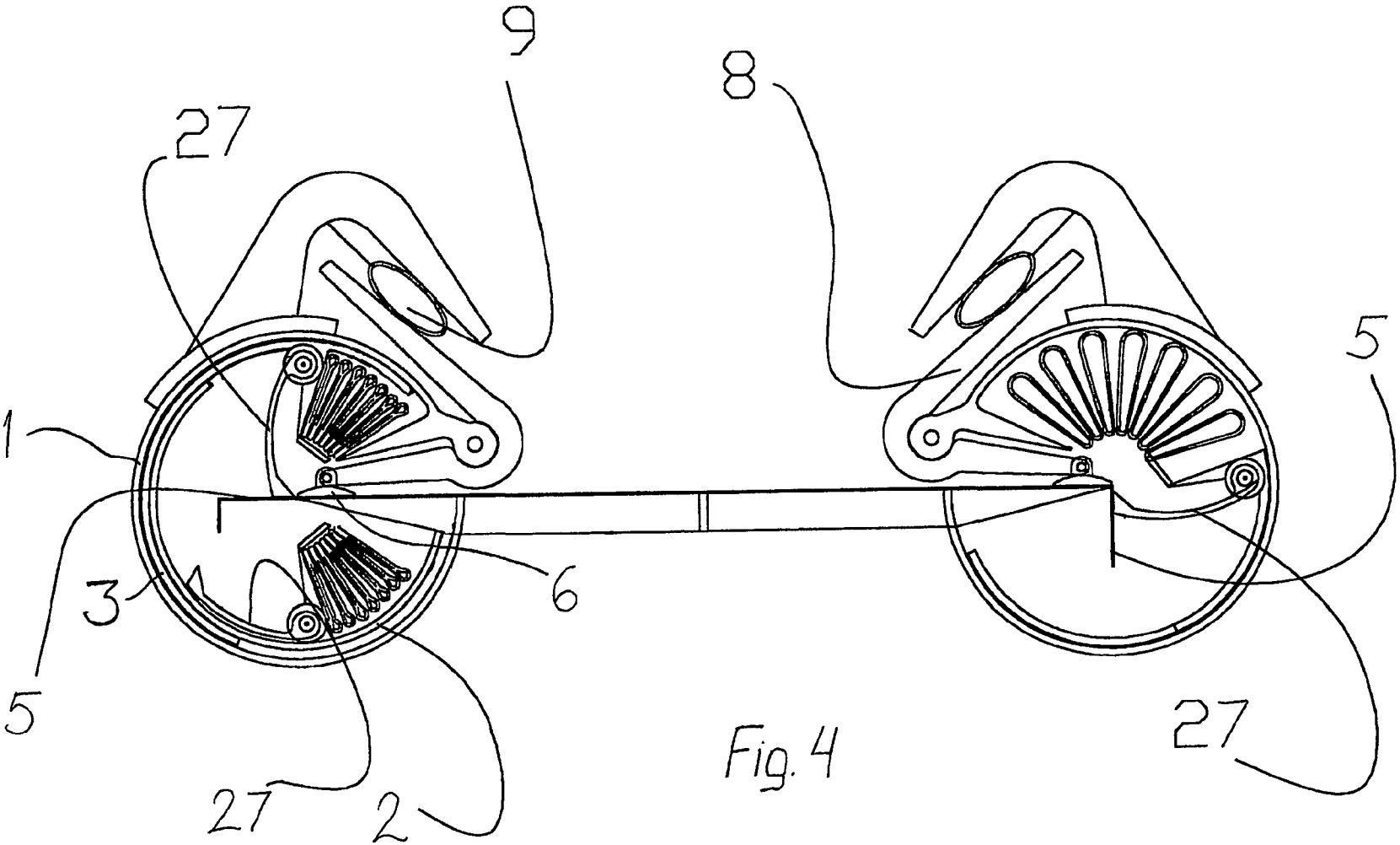

It is also possible to consider an embodiment for the invention (FIG. 4, left side), which contains three tube elements within each other and in which the innermost turning element 2 effects bending movement to one side while the middle element 3 effects it to the other side. The outermost tube element 1, inside of which said elements 2 and 3 are arranged to turn to opposite directions using their own actuators 4, is fixedly positioned and the holding clamp 6 is arranged pivotable by actuators 9 at its outer edge adjacent to the plate. FIG. 4 shows a second folding tool in the off-position and, in a corresponding manner, a tool operating in the opposite direction is in the working position. The bending tool 27 itself is in this case composed of a claw that is journalled pivotable in the rotating tube sector 2, 3 and whose free end contacts the plate in the working position. At least one of the claws is provided with means that can be used for turning it to the working position and off the working position.

Figure 3:
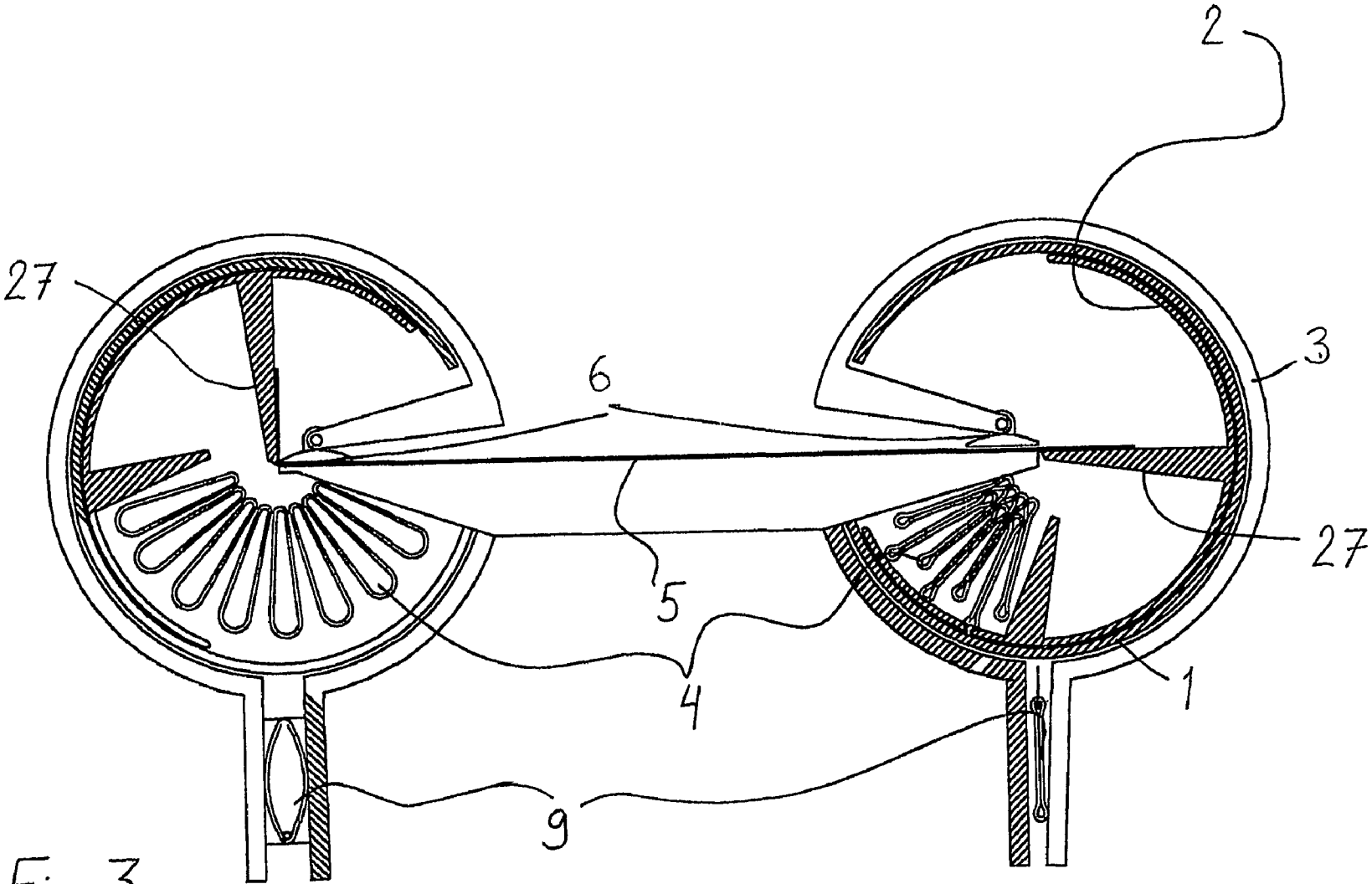
FIGS. 3, 4, 5, 6, 7A and 7B show other embodiments of the device.

In FIGS. 3 and 4 the actual means of the holding clamp 6 that presses the plate against the underlay is connected pivotally to a pivoting arm of the clamp, wherein it is placed over its entire surface against the surface of the plate.

The movements of the device are smooth and no point load stresses are caused. It should particularly be noted that in device of the invention the price of the structure increases more slowly than its width, whereas in conventional plate-bending devices the price increases at least proportionately to the second power of the constructional width. All in all, the plate-bending device according to the invention is more oriented to occupational safety than any device presently on the market. The operation of the device can be made faster when a pressure accumulator 17 for the hose-inflating fluid is used. An operating pump 20 can charge the pressure accumulator when the plate is not bent (FIG. 2).

It is preferable to arrange "lubrication" between the opposing sliding surfaces of the tube sectors that rotate within each other in a manner that pressurized air is brought from inside into the space between the tube elements that move relative to each other. In this case the air cushion principle is used. This "air cushion lubrication" is particularly effective when air is taken from an oil-lubricated compressor in a manner that the oil is not entirely separated from the air. The lubrication air is let to exit directly to the outer air. If air of 5 bar is used, the diameter of the tube shells is 600 mm, and the average lubrication carrying pressure is kept at 1.5 bar, the "lubrication force" obtained is almost 1000 MN/meter in length. If the device uses e.g. 5 bar of hydraulic pressure and it is e.g. 5 m in width and 600 mm in diameter, the torsional force available is 260000 Nm. Bending a steel plate of 2 mm over the width of 5 m requires, in turn, only 1500 Nm. Under the above conditions, the device can be used for bending steel plates up to the thickness of 27 mm. For strengthening the outer tube element in bendings that require this much power it is advantageous to use a reinforcing flange around the outer tube, in a position perpendicular to the tube. An adequate number of sufficiently thick reinforcement flanges are mounted.

Figure 5:
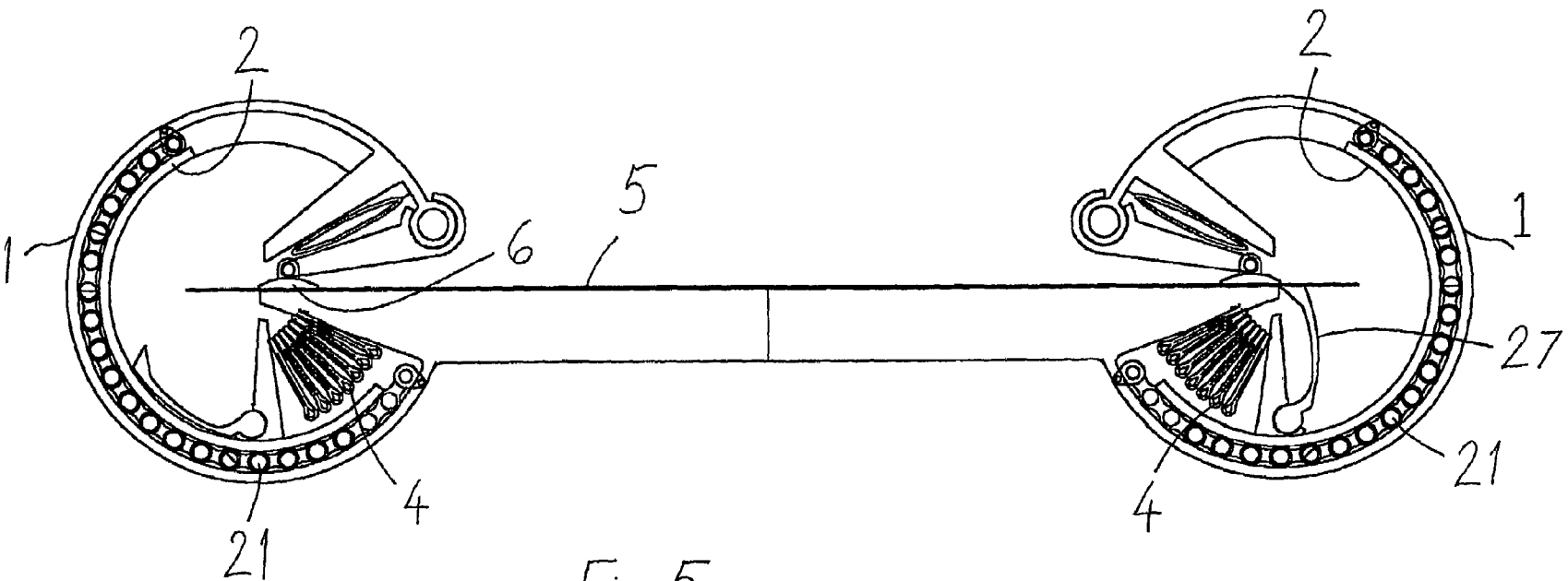

The movement between the tubes can naturally be made rotable also by using a conventional system, which is illustrated in FIG. 5. Here the movement is made rotable by means of rollers of roller chains 21. The roller chains can be placed at sufficient distances from each other between the rotating tube elements 1, 2.

Figure 6:
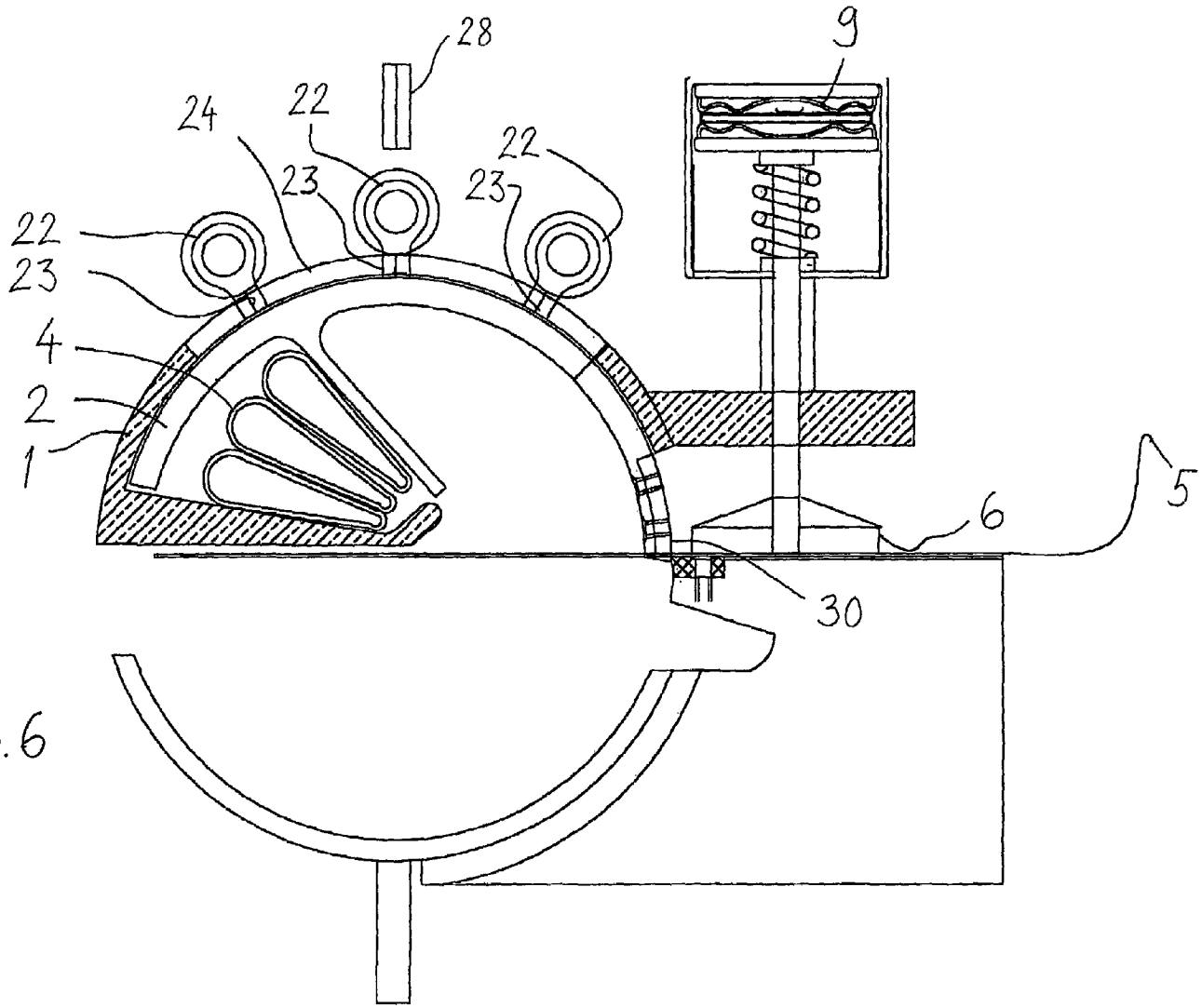

The movement of the tube elements, particularly when the device is constructed only for cutting a plate, can be made rotatable also on the outside, e.g. by using ball bearings 22, as shown in FIG. 6. The bearings 22 are fixed to the inner, turning tube 2 and their holding means 23 penetrates through the outer, fixed tube 1 along a track 24. Thus, the extent of the tube sector can be as little as under 180°. In other solutions according to this invention the sector extent is over 180° in order to keep them together at different positions. The fact that the rotating movement is brought about as a movement between at least two tube elements or sectors leads to small and evenly distributed surface pressures also between the tube elements. This reduces structural thicknesses and the price of the construction.

Figures 7A, 7B:
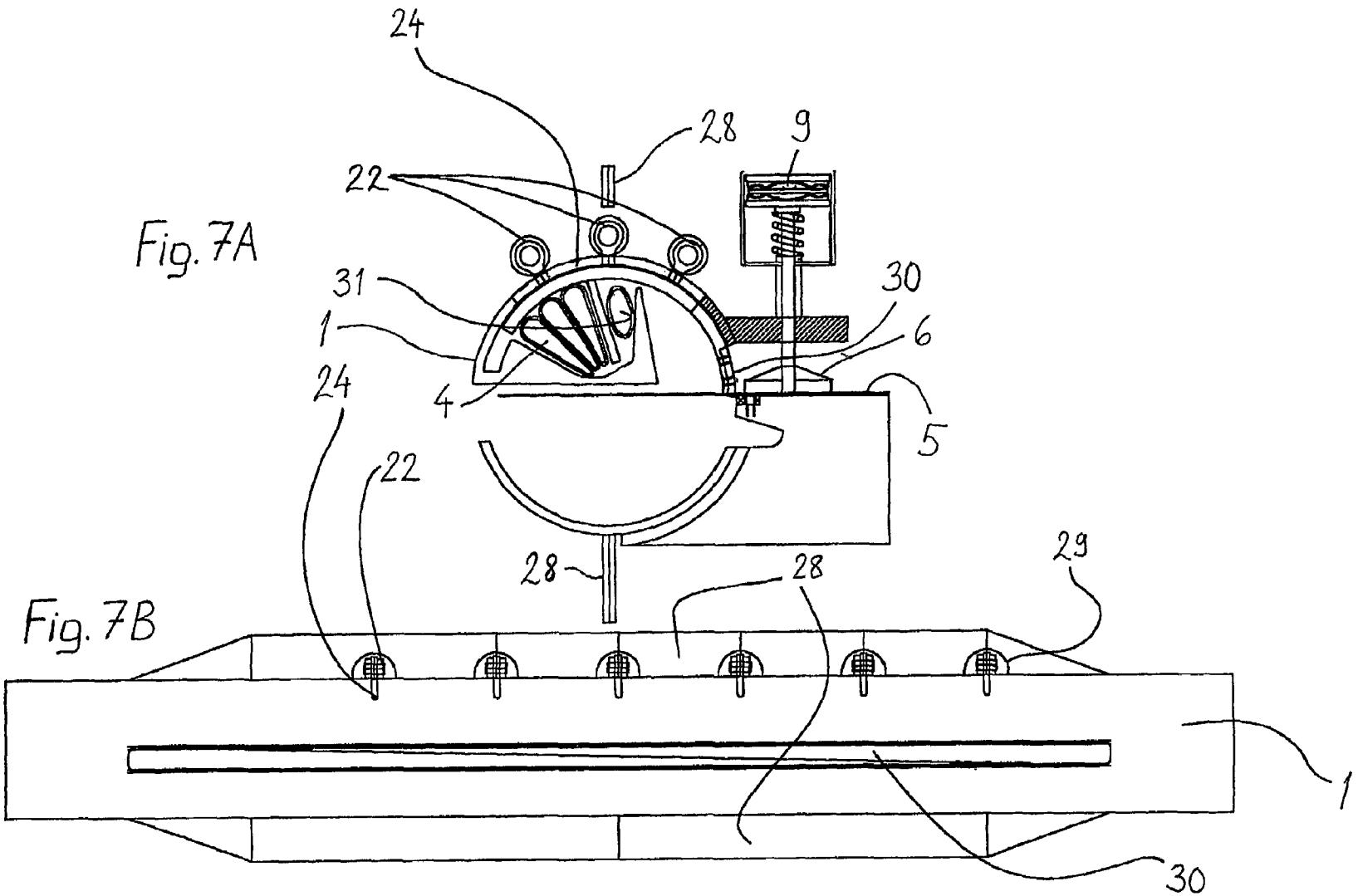

When the working device consisting of tube elements is used only for cutting a plate, the track of the plate 5 can be opened also on the other side of the tube elements in order to let the plate pass through the device entirely, as illustrated in FIGS. 6, 7*a* and 7*b*. The edge of the turning inner tube element 2 operates then as a blade cutting the plate. FIGS. 6 and 7*a* and 7*b* also show a holding means 6, which is arranged to the outer, fixed tube sector 1, at its projection, to move linearly by an actuator 9 and pressing the plate 5 against its underlay. FIG. 7 shows also plate-like enforcements 28, which extend parallelly to the tube elements and are located on the outer surface of the outer, fixed tube element 1. One enforcement 28 comprises apertures 29 for the supporting bearings 22. A rising cylinder blade, which is attached to the edge of the inner, moving tube element 2, is indicated with reference 30. FIG. 7 further shows an actuator 31 for the return movement of the tube element 2, which actuator operates against the operative direction of the actuators 4 of the working movement, and can also operate by pressure medium.

Figure 8:
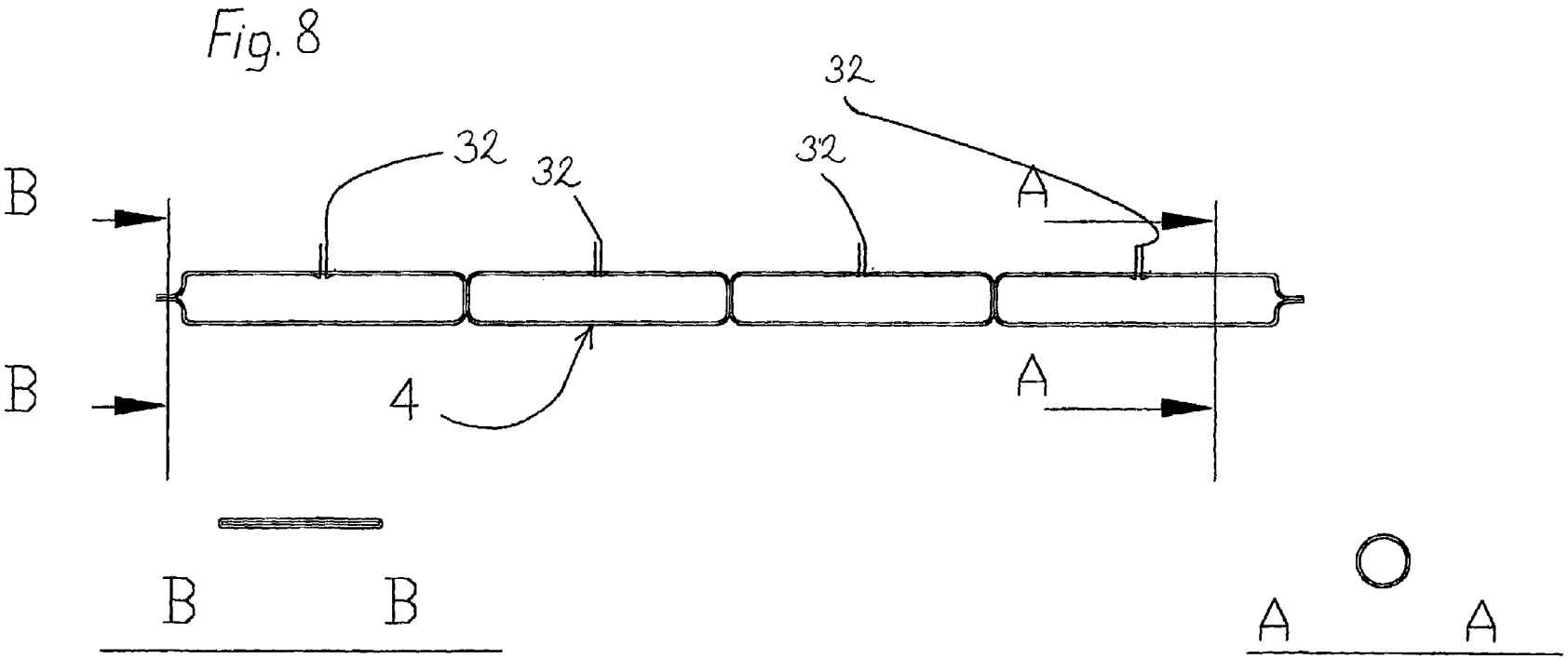
FIG. 8 shows one possible structure of the hose-like actuator.

When a narrow plate blank is processed by a wide plate-processing device it is advantageous that the inflating power elements of the actuators 4 are divided into a plurality of different sections in relation to length, as is shown in FIG. 8, in a manner that pressure medium is pumped only to the section in which the working, bending or cutting takes place.

Points at which pressure medium is supplied separately for each section are indicated with reference 32. Thus, time and capacity of the pump or the compressor are saved.

The directions from which the plates are supplied to the device are determined on the basis of the positioning of the tube sectors 1, 2, i.e. the tube elements. They can be positioned in a manner that a path passing through the device is formed approximately in parallel with the diameter, i.e. supply takes place in a direction substantially perpendicular to the rotation axis, as described above. When supplying from this direction the plate can be bent gradually when the supplying proceeds, wherein curved or polygonal forms can be obtained in the plate, depending on the structure of the bending tool.

Another alternative supplying direction is the direction of the rotation axis. Thus, the plate can be supplied e.g. between two tube sector units and both edges of the plate can be worked. The tube sector units are not necessarily parallel, but they can form an angle, wherein plates can e.g. be cut to a conically tapering form. The device can be adjustable, wherein rotation axes of the tube sectors located on both edges can be set to a desired angle relative to each other.

If the plate is supplied to the device in a manner that it is located over the entire length of the device (longitudinal direction refers here to the direction of the rotation axis of the tube sector), the actuators divided in compartments (FIG. 8) can be pressurized in phases always at the point where the working takes place, and thus it is possible to proceed from one end to the other. Each compartment is advantageously emptied after having been passed by the worked point.

Figure 9:
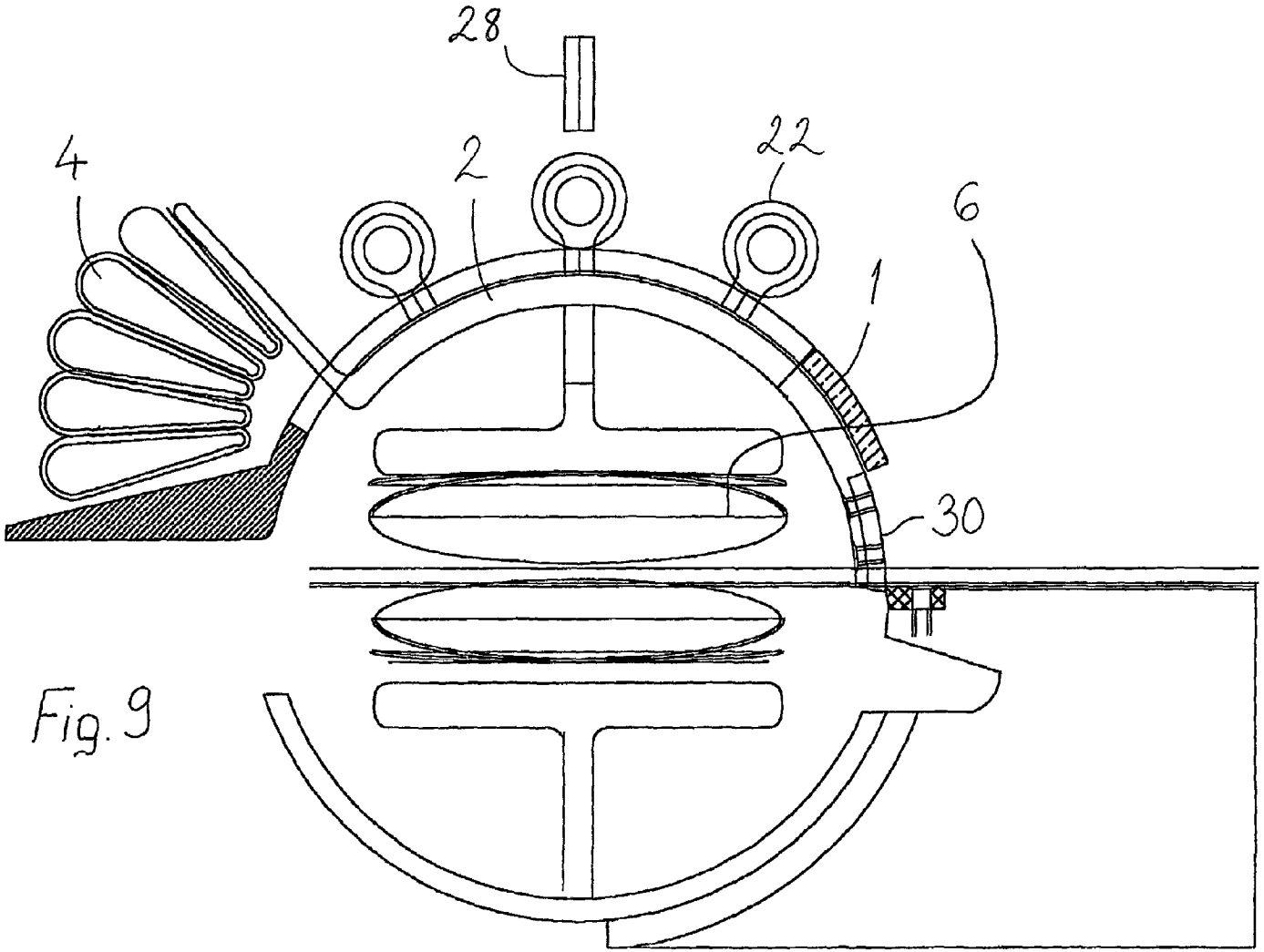
FIG. 9 shows one embodiment of the device.

FIG. 9 shows an option in which hose-like actuators 4 are outside the tube sector 1, 2 and act between the projections projecting radially from the tube sectors. Also this option relates to a cutting device. The figure shows also how the plate-holding means 6 can be arranged inside the tube sectors e.g. in a manner that the plate can be supplied in the direction of the diameter through the device between the pressing surfaces of the holding means 6.

Figure 10A:
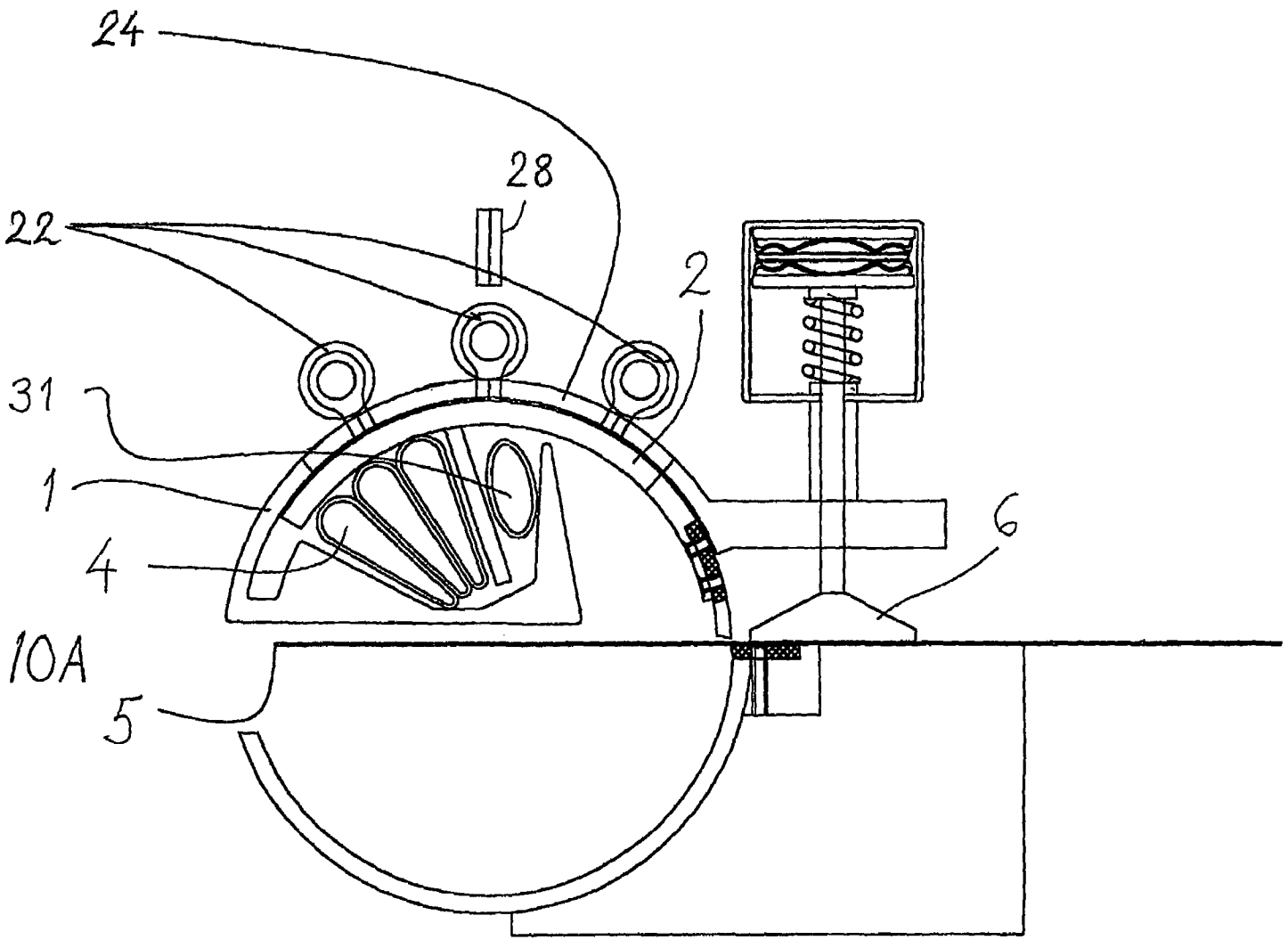
FIGS. 10A and 10B show one embodiment of the device and supplying a plate thereto.
Figure 10B:
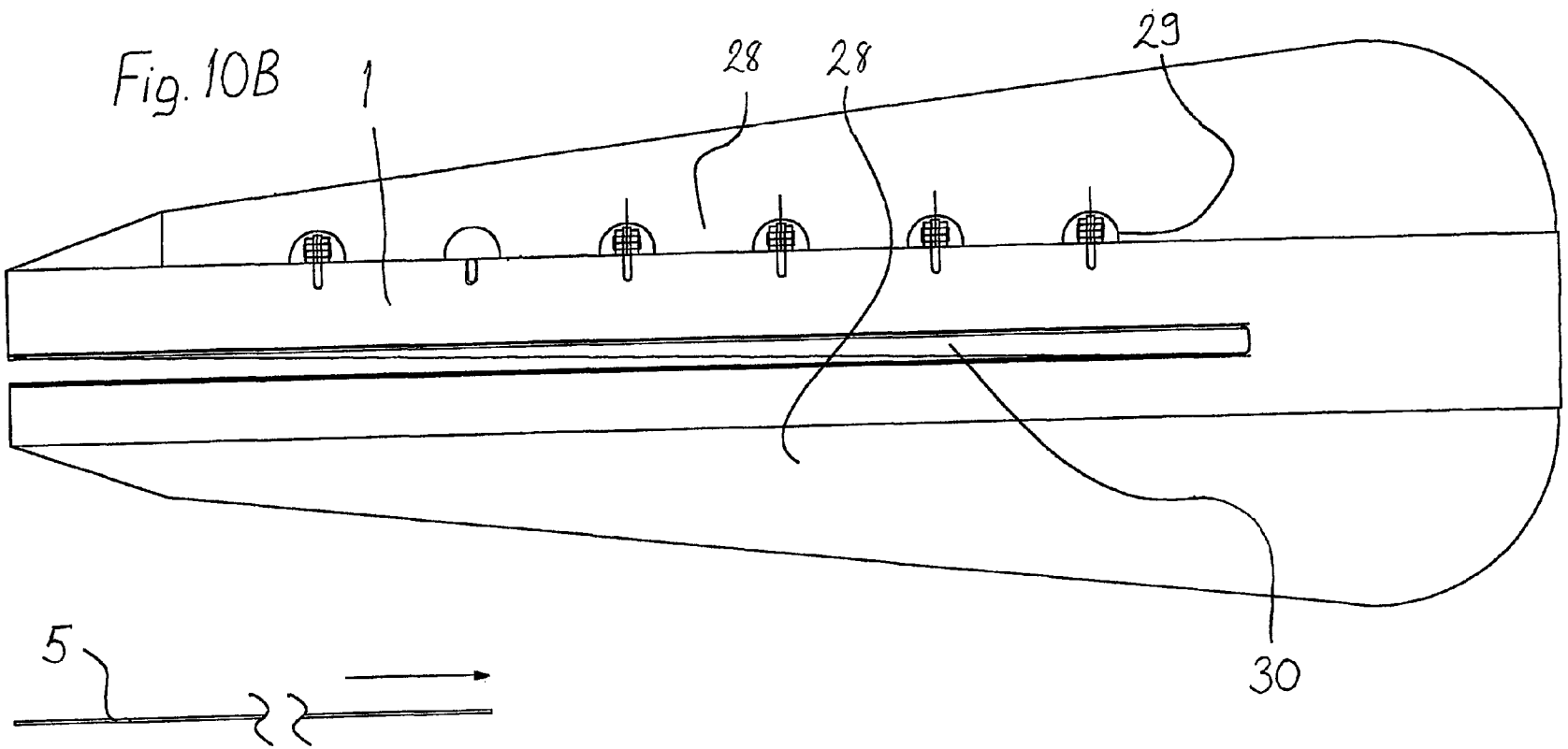

FIGS. 10*a* and 10*b* show an option relating to a cutting device which makes it possible to feed the plate through the direction of the diameter, or the plate can also be supplied at the end. The figure shows also the ascent of the cutting blade.

Figure 11:
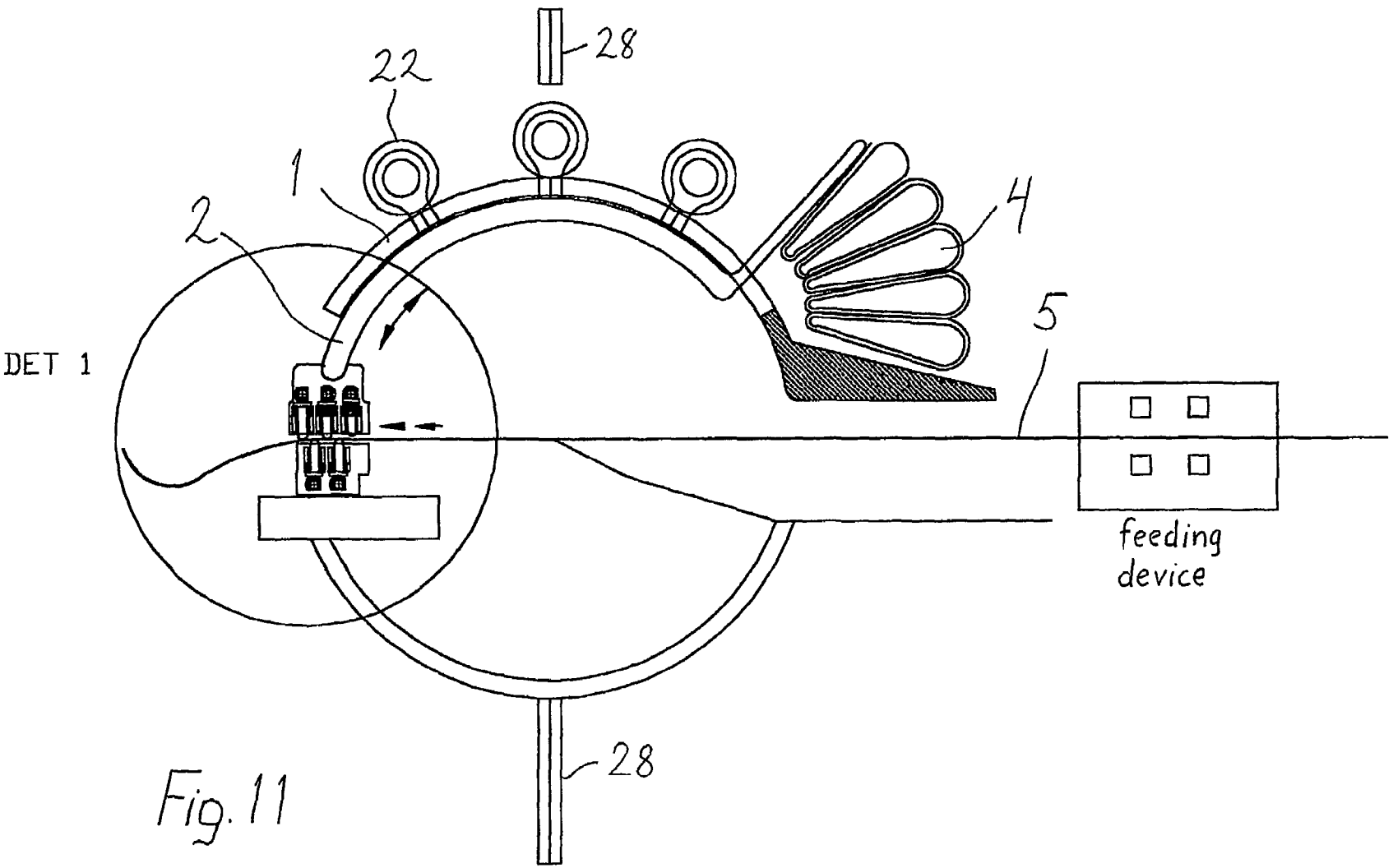
FIGS. 11 to 12 show one embodiment of the bending tool of the device.
Figure 12:
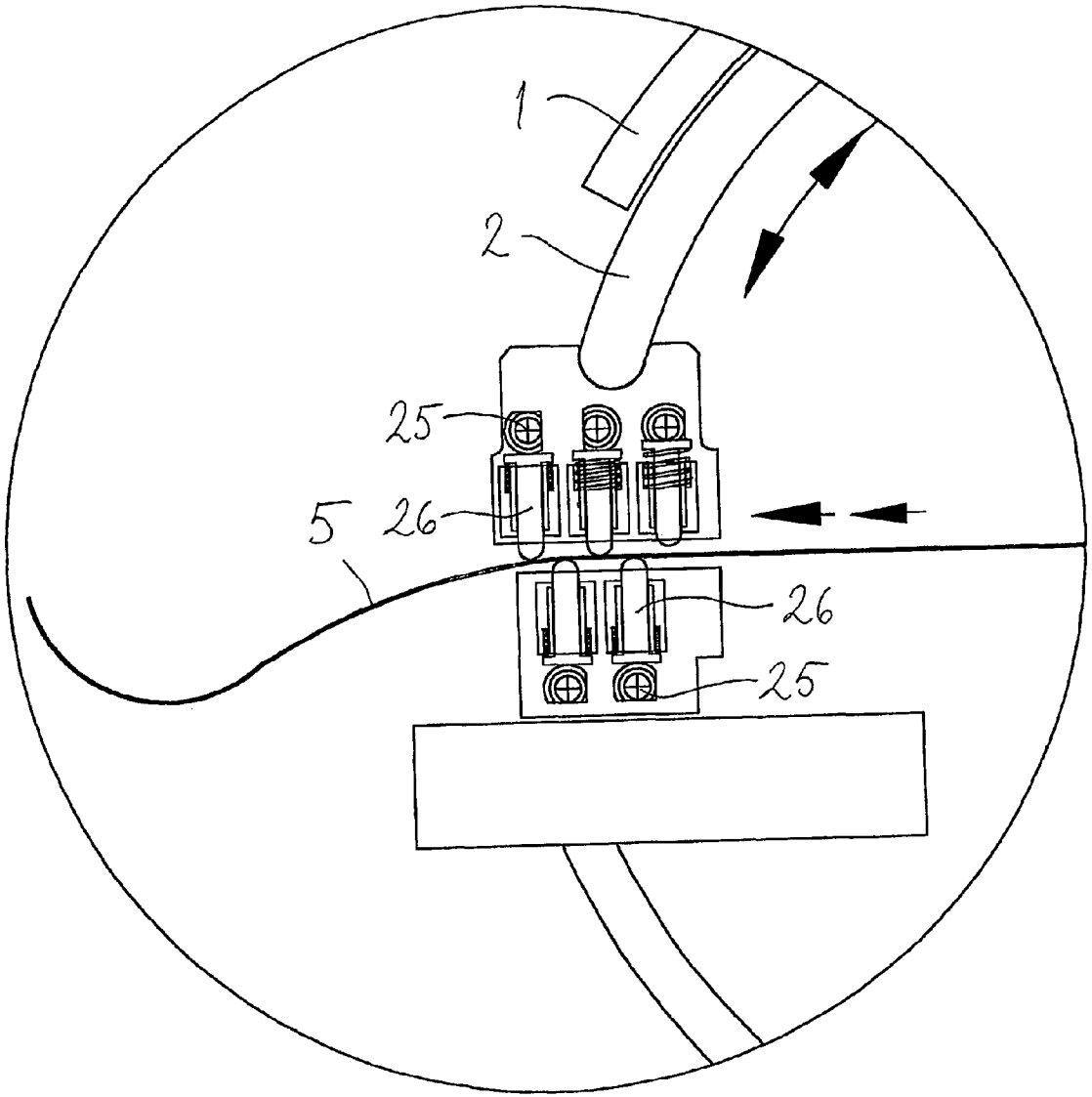
Figure 13:
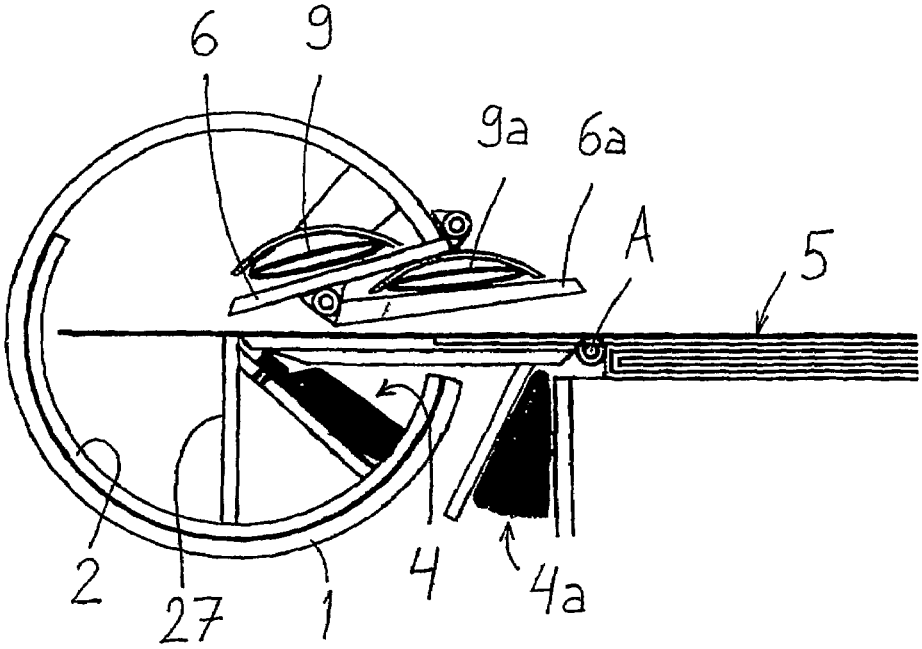
FIGS. 13 to 16 show yet another embodiment of the device.
Figure 14:
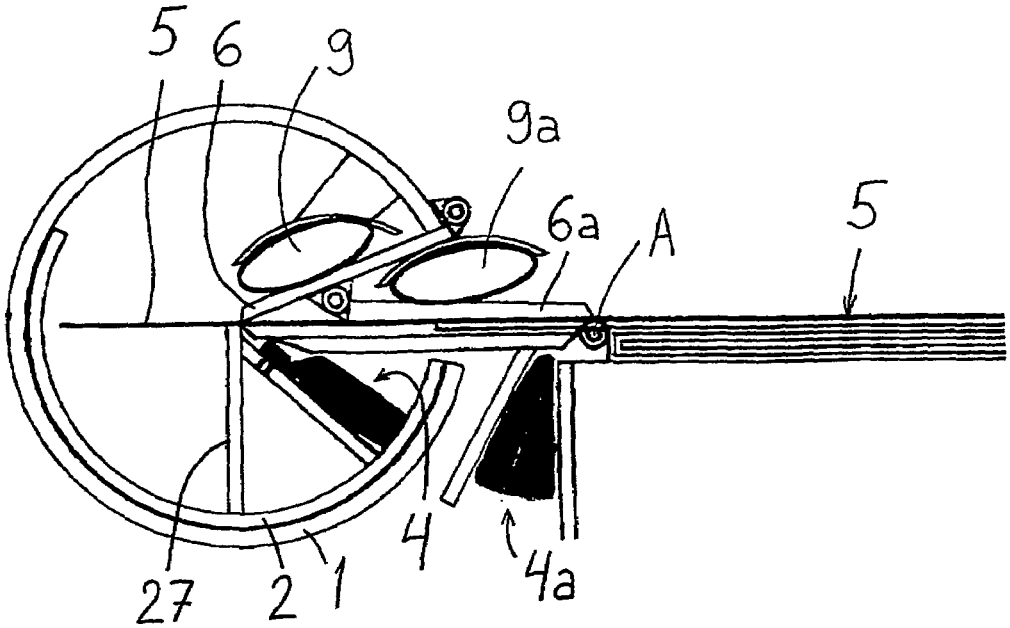

FIGS. 11 to 12 show how the forming tool at the edges of the tube element comprises, on both sides of the plate, strips, profiles or the like 26, which are moved by eccentrics 25 independently from the rotation movement of the tube sectors and by means of which the plate can be bent to different forms. Eccentrics 25, which act against the power of return springs for pushing the strips 26 against the plate 5, have three positions depending on the distance of the corresponding pushing surface from the rotation axis of the eccentric: off-position in which the free edge of the strip does not touch the plate on the gap, hold-position in which the edge touches the surface of the plate that is parallel with the supply plane, and working position in which it penetrates to the other side of the supply plane of the plate. As the figure shows, the strips, profiles or the like 26 are alternately pushed from the opposite sides of the plate-supplying gap towards the plate 5.

FIGS. 13 to 16 show an alternative in accordance of which the tube sectors 1, 2, which are positioned within each other, are themselves arranged to turn around a supplementary axis A that lies outside the tube sectors, in the same plane in which the relative rotation movement of the tube sectors 1, 2 takes place. To implement this, a supplementary holding clamp 6*a* is arranged pivotable in the holding clamp 6 or the like in the outer tube sector, to press against the plate 5 that is bent, by the effect of supplementary actuators 9*a* outside the tube sectors 1, 2. These actuators 9*a* are also hose-like actuators, which inflate by the effect of medium, particularly air, and they act between the holding clamp 6 and the supplementary holding clamp 6*a*. Both the holding jaws 6, 6*a* and the corresponding actuators 9, 9*a* are shown operative in FIG. 14.

Figure 15:
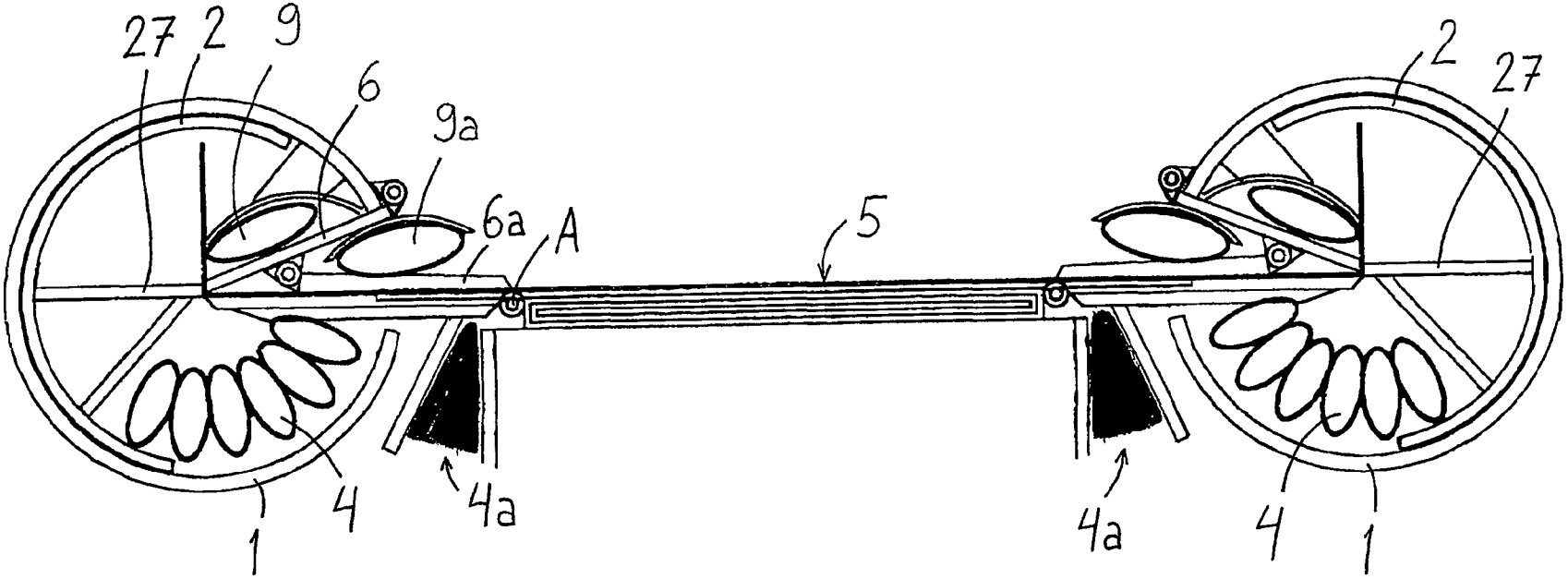
Figure 16:
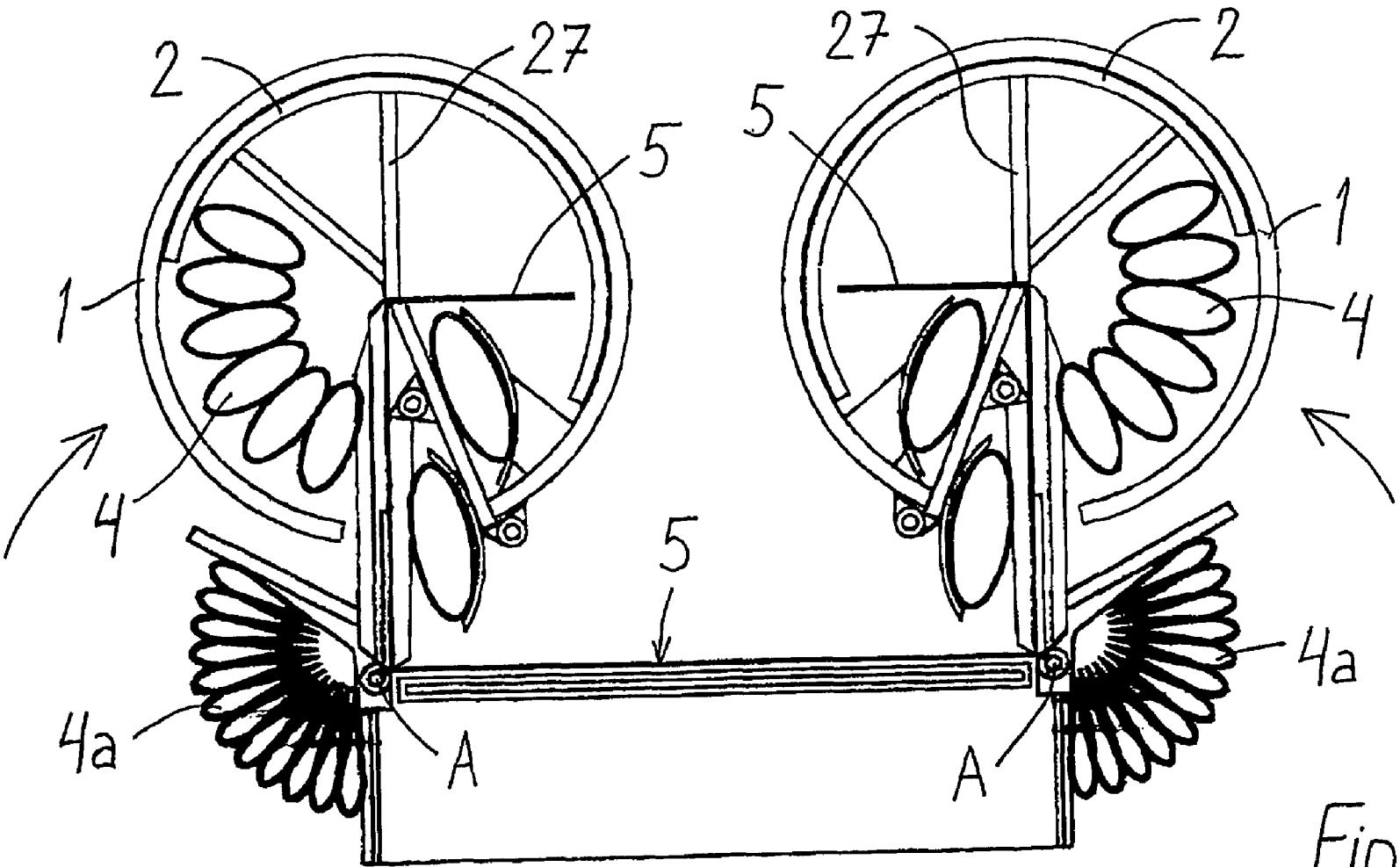

FIG. 15 shows how the first bending is carried out by the movement of the tube sector 2. FIG. 16 shows a second bending around the supplementary axis A, which bending is situated more centrally in the plate 5 compared to the first bending location and brought about by using supplementary actuators 4*a*, which act between the frame of the device or a corresponding fixedly-positioned supporting structure and the tube sectors 1, 2, and which also are inflatable by the effect of medium, particularly air. As becomes evident from FIGS. 15 and 16, the tube sectors 1, 2 and the supplementary axes A positioned more centrally from them, and the corresponding actuators 4*a* can be located mirror-symmetrically on both sides of the plate 5 to process the plate at both edges.

The invention is not restricted to what has been described above, but it can be modified within the scope of the inventive idea presented by the claims. Different tools can be changed to the rotating tube sector according to the desired working method. Further, the device can be provided with a function in which holes are punched in a plate by a rectilinear movement by connecting the punching tool by means of a linear guide and a driving rod to the tube sector performing the rotating movement. The fixed tube sector 1, relative to which the rotation movement of one or two moving tube sectors 2, 3 takes place, does not need to be made of a plate of even thickness, but it can also form a "housing" with a circular inner surface, in which housing the rotating tube sectors are made rotatable. Nevertheless, a fully tube-like form is preferably for a light-weighted structure.

Moreover, it is possible to arrange the plate to be supplied in a manner that the plate it kept in place by suitable attaching means and the device is moved in relation thereto, e.g. when the plate is worked on both edges simultaneously.

The invention is applicable for processing all types of plate materials to be worked, particularly for processing sheet metal carried out by bending or cutting.

What is claimed is:

1. A plate processing device intended to be used for bending or cutting of bending and bendable plate-like objects and comprising a bending or cutting tool arranged to be moved by actuators, the tool having a width corresponding to a length of a bending or cutting line, the device comprising:

at least two tube sectors arranged one within the other and rotatably moving with respect to each other, of which the tube sector that rotates around a rotation axis has a bending or cutting tool, the mutual movement of the tube sectors being effected by means of actuators acting between the tube sectors, expandable by means of pressure of a medium, and being hose-like power elements whose length is substantially equal to the width of the whole tool, said hose like power elements being selected from:

one hose-like power element, or a plurality of hose-like power elements in parallel or in series.

2. The device as set forth in claim 1, wherein the hose-like power elements are divided, in view of the width of the tool, into more than one separately pressurized compartment, in a manner that by pressurizing said compartment, use of a wide tool is possible for working plate blanks that are substantially narrower than the tool.

3. A plate processing device intended to be used for bending plate-like objects and comprising a bending tool arranged to be moved by actuators, said device comprising:

tube sectors arranged within each other and moving with respect to each other around a rotation axis, said tube sectors comprising a fixedly positioned tube sector and two tube sectors rotating in opposite directions in a movement around the rotation axis and comprising each a bending tool, the movement of the tube sectors rotating in opposite directions being effected by means of actuators acting between the tube sectors and being expandable by means of pressure of a medium, wherein in both tube sectors rotating in opposite directions there is attached a claw that operates as a bending tool for bending the same plate in opposite directions and that at least one of these claws is provided with a means which can be used to turn the claw into a working position or away from the working position.

4. A plate processing device intended to be used for bending or cutting of bending and bendable plate-like objects and comprising a bending or cutting tool arranged to be moved by actuators, the device comprising:

at least two tube sectors arranged one within the other and rotatably moving with respect to each other, of which the tube sector that rotates around a rotation axis has a bending or cutting tool, and that the mutual movement of the tube sectors is effected by means of actuators acting between the tube sectors and being expandable by means of pressure of medium, wherein opposite surfaces of the tube sectors that move relative to each other are formed as sliding surfaces, a space between the sliding surfaces of the tube sectors, in which space the sliding surfaces move in relation to each other, being lubricated with the same pressure medium that brings about the mutual movement of the tube sectors.

5. The device according to claim 4, wherein pressurized air is directed to the space between the tube sectors that move relative to each other to keep the sliding surfaces out of contact of each other during the rotation.

6. A plate processing device intended to be used for bending or cutting of bending and bendable plate-like objects and comprising a bending or cutting tool arranged to be moved by actuators, the device comprising:

at least two tube sectors arranged one within the other and rotatably moving with respect to each other, of which the tube sector that rotates around a rotation axis has a bending or cutting tool, the mutual movement of the tube sectors being effected by means of actuators acting between the tube sectors and being expandable by means of pressure of a medium, the movement between the tube sectors being provided with rotating bearing elements, which are located in a space between the tube sectors.

7. The device according to claim 6, wherein the rotating bearing elements located in the space between the tube sectors are journalled in a chain.

8. A plate processing device intended to be used for bending or cutting of bending and bendable plate-like objects and comprising a bending or cutting tool arranged to be moved by actuators, the device comprising:

at least two tube sectors arranged one within the other and rotatably moving with respect to each other, of which the tube sector that rotates around a rotation axis has a bending or cutting tool, the mutual movement of the tube sectors being effected by means of actuators acting between the tube sectors and being expandable by means of pressure of a medium, the device further comprising a holding means for keeping a plate at place and attached to a stationary tube sector for keeping the plate, by means of pressing force, at its underlay while the plate is worked.

9. A plate processing device intended to be used for bending plate-like objects and comprising a bending tool arranged to be moved by actuators, the device comprising:

at least two tube sectors arranged one within the other and rotatably moving with respect to each other, of which the tube sector that rotates around a rotation axis has a bending tool, the mutual movement of the tube sectors being effected by means of actuators acting between the tube sectors and being expandable by means of pressure of a medium, the bending tool comprising strips or profiles arranged to move substantially perpendicularly to a support plane of the plate, independently from the movement of the tube sector, said strips or profiles being arranged on the opposite sides of the plate to bend it.

10. The device according to claim 9, wherein the strips or profiles are arranged to move by means of eccentrics having rotation axes that are parallel to the longitudinal edges of the strips or, profiles.

11. A plate processing device intended to be used for bending plate-like objects and comprising a bending tool arranged to be moved by actuators, the device comprising:

at least two tube sectors arranged one within the other rotatably and moving with respect to each other, of which the tube sector that rotates around a rotation axis has a bending tool, the mutual movement of the tube sectors being effected by means of actuators acting between the tube sectors and being expandable by means of pressure of a medium, the tube sectors being arranged to turn together around a supplementary axis located outside the rotation axis, and comprising a supplementary holding means for a plate, which is arranged to keep the plate at its place for bending that is carried out at said supplementary axis.

12. A plate processing device intended to be used for bending or cutting of bending and bendable plate-like objects and comprising a bending or cutting tool arranged to be moved by actuators, the device comprising;

at least two tube sectors arranged within each other and moving with respect to each other, of which the tube sector that rotates around a rotation axis has a bending or cutting tool, the mutual movement of the tube sectors being effected by means of actuators acting between the tube sectors and being expandable by means of pressure of a medium, the movement between the tube sectors being provided with rotating bearing elements, which are supported by an outer surface of an outer tube sector.

13. A plate processing device intended to be used for bending or cutting of bending and bendable plate-like objects and comprising a bending or cutting tool arranged to be moved by actuators and having a width corresponding to a bending or cutting line, the device comprising:

at least two tube sectors arranged one within the other rotatably and moving with respect to each other, of which the tube sector that rotates around a rotation axis has a bending or cutting tool, the mutual movement of the tube sectors being effected by means of actuators acting between the tube sectors, expandable by means of pressure of a medium, and being elongated deformable means whose length extends parallel with the bending or cutting line.

* * * * *